US008942426B2

(12) United States Patent
Bar-Am

(10) Patent No.: US 8,942,426 B2
(45) Date of Patent: Jan. 27, 2015

(54) ON-TRAIN RAIL TRACK MONITORING SYSTEM

(75) Inventor: Michael Bar-Am, Zichron Yaakov (IL)

(73) Assignee: Michael Bar-Am, Zichron Yaakov (IL)

( * ) Notice: Subject to any disclaimer, the term of this patent is extended or adjusted under 35 U.S.C. 154(b) by 2375 days.

(21) Appl. No.: 11/679,556

(22) Filed: Feb. 27, 2007

(65) Prior Publication Data

US 2007/0217670 A1 Sep. 20, 2007

Related U.S. Application Data

(60) Provisional application No. 60/778,956, filed on Mar. 2, 2006.

(51) Int. Cl.

| | |
|---|---|
| ***G06K 9/00*** | (2006.01) |
| ***B61L 23/00*** | (2006.01) |
| ***B61L 23/04*** | (2006.01) |
| ***B61K 9/08*** | (2006.01) |

(52) U.S. Cl.

CPC ..... *B61L 23/048* (2013.01); *B61K 9/08* (2013.01); *B61L 23/041* (2013.01); *B61L 23/045* (2013.01); *B61L 23/047* (2013.01)

USPC ..... 382/104; 382/106; 382/107; 382/181; 382/209; 104/242; 73/146

(58) Field of Classification Search

USPC ..... 382/104, 106, 107, 181, 209; 104/242; 73/146

See application file for complete search history.

(56) References Cited

U.S. PATENT DOCUMENTS

| | | | | |
|---|---|---|---|---|
| 4,932,784 | A * | 6/1990 | Danneskiold-Samsoe | 356/602 |
| 5,347,588 | A * | 9/1994 | Wilson | 382/104 |
| 5,808,906 | A * | 9/1998 | Sanchez-Revuelta et al. | 702/151 |
| 6,163,755 | A * | 12/2000 | Peer et al. | 701/301 |
| 6,356,299 | B1 * | 3/2002 | Trosino et al. | 348/128 |
| 6,546,791 | B2 * | 4/2003 | Yurjevich | 73/146 |
| 6,600,999 | B2 * | 7/2003 | Clark et al. | 702/35 |
| 6,768,551 | B2 * | 7/2004 | Mian et al. | 356/446 |

(Continued)

FOREIGN PATENT DOCUMENTS

JP 2005225469 A * 8/2005

OTHER PUBLICATIONS

Jenkins et al. "Train Derailment at a Broken Switch Rail." Journal of Failure Analysis and Prevention. 3.5 (2003): 6-11. Print.*

Wu, et al. "Railway Vehicle Derailment and Prevention." Handbook of Railway Vehicle Dynamics. 1. Boca Raton, FL: CRC Press, 2006. Print.*

(Continued)

*Primary Examiner* — Michael A Newman
(74) *Attorney, Agent, or Firm* — Oren Reches

(57) ABSTRACT

An automatic inspection system is provided for monitoring rail track for detecting and generating alerts for certain hazards to the operation of trains that may cause various safety concerns and even derailment. The monitoring is during normal railway service runs without interrupting the normal railway services. In one implementation, an imaging module is used on a passenger or freight train to capture video images of the rail track under the train in motion. In one implementation, the captured video images are automatically processed in a computer using a software module which is based on digital image processing techniques and algorithms to determine whether an irregularity is present on the rail track. In one implementation, video images containing detected irregularities on the rail track are transmitted to a control center for further analysis and possible alert.

21 Claims, 2 Drawing Sheets

(56) References Cited

U.S. PATENT DOCUMENTS

| | | | | |
|---|---|---|---|---|
| 2001/0035907 | A1* | 11/2001 | Broemmelsiek | 348/169 |
| 2003/0048193 | A1* | 3/2003 | Puckette et al. | 340/679 |
| 2003/0222981 | A1* | 12/2003 | Kisak et al. | 348/148 |
| 2004/0130618 | A1* | 7/2004 | Kilian | 348/61 |
| 2004/0263524 | A1* | 12/2004 | Lippincott | 345/541 |

OTHER PUBLICATIONS

Anderson, R.T. (2003). Quantitative analysis of factors affecting railroad accident probability and severity. Informally published manuscript, Graduate College, University of Illinois, Urbana-Champaign, U.S. Retrieved from http://ict. illinois.edu/railroad/CEE/pdf/Thesis/Anderson%20MS%20thesis%20%28final%29.pdf.*

* cited by examiner

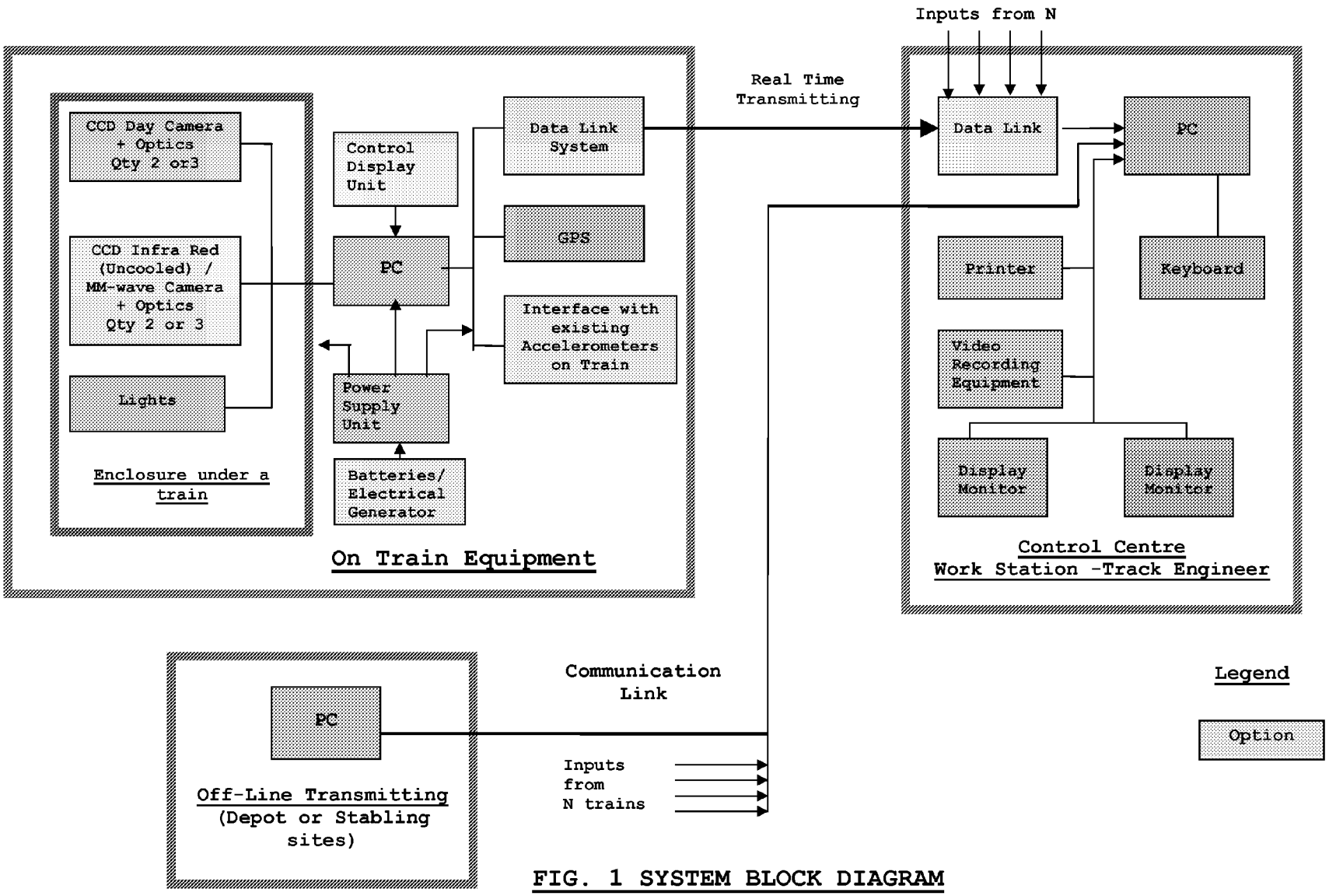
FIG. 1 SYSTEM BLOCK DIAGRAM

FIG. 2 -WRI MONITORING PROCESS
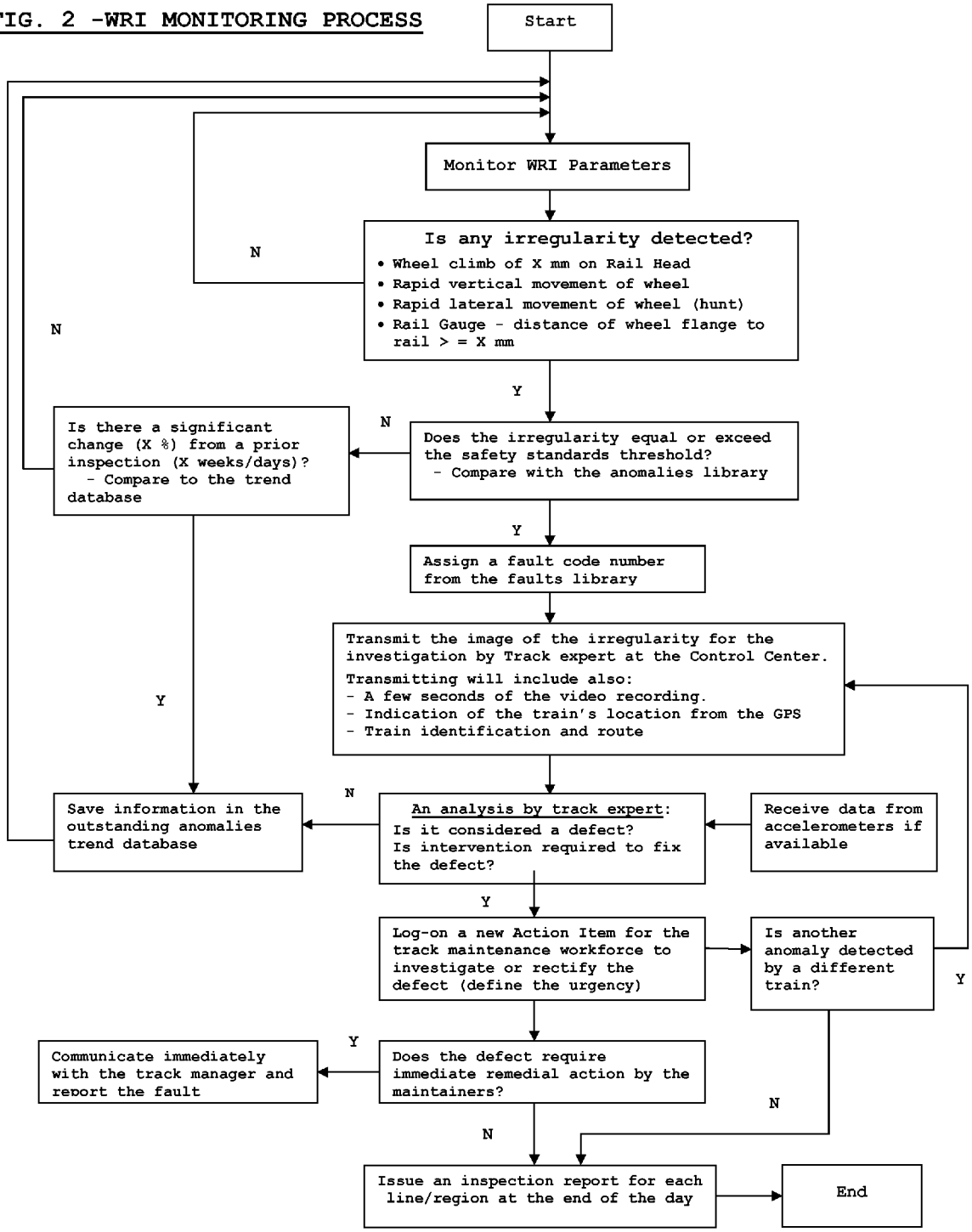

ON-TRAIN RAIL TRACK MONITORING SYSTEM

This application is based on the provisional application No. U.S. 60/778,956 filed on Mar. 2, 2006, the priority of which is claimed.

BACKGROUND

This application relates to automatic inspection of rail track, for the detection of and generating alerts for certain hazards on rail tracks.

In railway systems, certain defective conditions on rail tracks are hazardous to operations of trains and may cause various safety concerns and even derailment. A hazardous condition can occur at any location in the railway systems. Hence, rail tracks must be inspected to detect the hazardous condition and, depending on the nature and magnitude of the detected hazardous condition, an appropriate corrective measure, if needed, is taken to rectify the detected hazardous condition.

Some defective conditions of rail tracks may be detected via visual inspections by rail track technicians or engineers who patrol along the rail tracks. Visual patrol inspections are labor intensive, time consuming, and highly dependent on the skills and sometimes physical conditions of individual inspectors, and the lighting and weather conditions.

Specially designed inspection vehicles such as track recording vehicles may be equipped with various sensors including cameras and video recorders to inspect rail tracks. The electronic imaging and other devices (e.g., ultrasonic sensors) used in track recording vehicles can capture images and various data of the rail tracks for further analysis of any defects or hazards by a rail track engineer or inspector. The use of such inspection vehicles may require designated inspection periods different from regular railway service schedules to run the inspection vehicles through rail tracks to be inspected.

SUMMARY

This application describes rail track inspection and monitoring techniques and systems that allow for automatic inspection of rail tracks by monitoring the interface between the wheel and rail and the condition of critical track components on regular trains during normal railway service runs without interrupting the normal railway services.

In one implementation, a method is provided for monitoring a rail track. An imaging module is used on a passenger or freight train to capture video images of the rail track under the train in motion. The captured video images are automatically processed in a computer on the train to determine whether an irregularity is present on the rail track to adversely affect safety of the train.

In another implementation, a method for monitoring a rail track is provided to capture video images from a moving passenger or freight train operating on the rail track during a regular service run of the train. The captured video images are then processed in a computer on the train to determine whether an irregularity is present on the rail track according to a set of predetermined irregularity criteria. Video images that contain detected irregularities on the rail track are selected for further analysis of each detected irregularity.

In yet another implementation, a method for monitoring a rail track includes capturing video images from a moving train operating on the rail track; and automatically processing captured video images using a digital motion detection algorithm to monitor an interface between a wheel of the train and the rail track.

In yet another implementation, a method for monitoring a rail track includes capturing video images from a moving train operating on the rail track; automatically processing captured video images using a digital image matching algorithm to compare the captured video images to stored images of irregularities of the rail track in a digital library to find a match; analyzing a matched video image to determine the nature of an irregularity; and generate an alert signal to alert the irregularity if a parameter of the irregularity exceeds a safety standard threshold.

These and other features and implementations are described in greater detail in the following description, the drawings, and the claims.

BRIEF DESCRIPTION OF THE DRAWINGS

The drawings are only for purposes of illustrating a preferred method and are not to be construed as limiting the invention:

FIG. 1 illustrates a system block diagram.

FIG. 2 illustrates a WRI monitoring process.

DETAILED DESCRIPTION

Implementations of the on-train rail track monitoring described in this application may be used to capture images and data for further analysis by a computer or an inspection specialist at a later time, and to automatically detect selected irregularities or hazardous conditions via on-train software processing of the captured images and data during the normal run of the train without involvement or input of the train operator or driver. Hence, in such implementations, the on-train computer processes the captured images and data as they are being captured and the automatic detection is in real time. In some implementations, the on-train system may be configured to identify first signs of an irregularity and deteriorating track condition such that a proper corrective action can be timely taken to intervene before the condition develops into a service or safety issue. Certain selected critical hazardous conditions may be programmed in the on-train system according to safety standards for the automatic detection by the on-train computer. For example, missing or defective components such as voided ties, missing chairs, clips, and other types of track critical components may be selected as the critical hazardous conditions. Inspection of visible railhead defects may be carried out in some implementations. Warnings or alerts for the selected critical hazardous conditions are generated to alert the railroad and infrastructure operators with the aim of reducing the risk of derailment. The images of irregularities will be transmitted to a control center to be analyzed by a track expert who will decide whether an irregularity is a defect which is required to be further investigated and to be rectified, if needed, by the track workforce on-site. In the event that an irregularity is defined by the analyst as a defect, the urgency of rectifying the defect and notifying railroad operator and perhaps train operators will be dependent upon the level of risk identified by the track expert in the control center.

FIG. 1 illustrates one implementation of an on-train rail track monitoring system for use with a regular passenger or freight train during normal service routines. The system is represented by the functional block labeled as "On Train Equipment" and includes an under-train sensing module, an on-train computer as the on-train data processing station, and a positioning device which provides the position data of the train. The positioning device may include a global positioning system (GPS) or other positioning devices. The on-train system may also include a power supply unit (PSU) which receives electrical power from the existing power equipment of the train and converts the received power into suitable voltages/currents as needed for operating various components in the on-train monitoring system. A self-contained power supply unit including rechargeable batteries and/or an electrical generator may be used in some implementations. The system as an option may further include a communication device for linking the on-train computer to an off-train computer or computer storage device to transmit the captured images and data for further analysis.

The sensing module is located under the train to allow for detection of the defects in the rail tracks, and irregularities in the Interface of Wheel and Rail (WRI). The sensing module can include video imaging devices such as two or more CCD cameras or cameras with other imaging sensor arrays to capture the video images of the rail tracks and the WRI images, and one or more lights to illuminate the rail tracks and the wheel(s) under monitoring. Optionally, both day imaging devices and night imaging devices may be used to capture video images under different lighting conditions. The day imaging devices may be CCD cameras which capture the video images under well-lit conditions such as during the day time. The CCD cameras may also be used to capture video images under poorly lit conditions when proper illumination lights are used to illuminate the areas to be imaged. The night imaging devices, which may be Infrared (IR) cameras, are used to capture video images under poorly lit conditions, or harsh weather conditions. Millimeter-wave (MM-wave) cameras may be used for inspection in poor visibility conditions in bad weather (e.g. heavy fog, heavy rain, and heavy snow conditions). In implementations with three cameras as an option, the positions and the field of view (FOV) of one of the cameras may be set to cover the interface between the right-hand Rail and a corresponding right-hand wheel on the train, and it may cover the track components in the area of the right-hand rail. A second camera may have a FOV that covers the interface between the left-hand rail and the corresponding left-hand wheel on the train, and it may cover the track components in the area of the left-hand rail. The third camera may have a FOV that covers the whole track including the two rails, ties (sleepers), chairs and other supporting components of the rail. The sensing module and its components are designed for operation under extreme environment conditions in the railroad service regions where the railroad tracks are located.

The on-train computer, e.g., a personal computer (PC), may be programmed to automatically perform various imaging processing tasks without control or input from an operator on the train and to produce output image data files for the captured images and videos. The computer may also be used to control the sensing module and other on-train sub systems and to receive and process data other than captured images and videos. As illustrated in FIG. 1, the on-train system may include a communication unit to provide real-time transmission of the captured images and videos to a computer in an off-train control center manned by one or more engineers. This communication unit may be a wireless communication device to wirelessly transmit the data to the off-train control center. The on-train system may also include an interface with existing accelerometers on the train.

The on-train computer is programmed with image processing software to automatically detect irregularities in the rail tracks by monitoring the WRI and critical track components. The part of the software for the WRI monitoring is capable of detecting motion in video and is used to detect the dynamic phenomena of the interface between the wheel and the rail. The software further includes a pattern recognition module as a track condition monitoring (TCM) mechanism to detect missing critical parts of the track. In various implementations, based on pre-set criteria and the nature of a detected irregularity, the on-train computer is programmed to produce an alert signal to the railroad/maintenance operator about the detected irregularity.

FIG. 1 shows that the captured image and video data from the on-train system may be processed and transmitted in an off-line transmission to the off-train control center. The captured image and video data may be first transferred from the on-train computer to a data storage device or another computer and is subsequently transmitted to the control center, e.g., via a secured internet broadband connection.

The control center is designed to include a track monitoring work station for receiving the captured image and video data from one or multiple trains equipped with the on-train monitoring system. The monitoring work station may include one or more display monitors for displaying monitoring images and data transmitted from one or more trains, a data link receiver for receiving the real-time images and data from one or more trains, an Internet connection or other communication connection, a computer for analysis of the transmitted images and data, and video recording equipment that is either separate from the computer or is a function module provided by the computer for viewing and editing the video recording received from the trains. A printer may also be included for printing outputs from the on-train computer. A track expert at the control center can analyze the details of the captured images, video and data on selected irregularities from each train.

The above on-train monitoring system may also include a Deferential GPS (DGPS) unit as an option to increase the accuracy of the location identification when operated in areas where the DGPS infrastructure (e.g., presence of DGPS transmitters) is available. Another optional feature is a Control Display Unit (CDU) installed in the train operator cab which may include an indication panel to display the operating status of the sensors and subsystems and to indicate any faulty condition thereof. The CDU may also include a user interface for initiating and performing the calibration and the set-up process of the on-train monitoring system. A small display screen may be included in the CDU for viewing the camera output from the sensing module. The on-train monitoring system may be turned on by the train driver via pushing a control button at the start of the trip. Alternatively, the on-train monitoring system may be automatically turned on as part of the train start-up process and the system can be configured to continue to operate as long as the train is in motion. This can save an additional operation for the driver.

The on-train monitoring system can be installed on a regular passenger or freight train to automatically detect irregularities in the Wheel/Rail Interface (WRI) and track defects during the normal run of the train. This on-train monitoring system can be used to provide frequent inspections in regular service runs of the train and provide an efficient and convenient way to alert the railroad and the infrastructure operators of major hazards, thus reducing the risk of derailment. The system, in combination with the track expert at the control center, can be used to identify the first signs of an irregularity and a deteriorating track condition, such that an appropriate corrective action can be taken to intervene before the condition further degrades into a concern for the safe operation of the train. In addition, the system is used to provide an alert for an immediate short-term maintenance need or an imminent risk, and to trigger attention to certain locations in the rail tracks for further detailed inspections and corrective measures.

In applications, the on-train monitoring system may be used as a supplement monitoring system and operate in combination with and supplement other monitoring mechanisms such as visual patrol monitoring and track recording vehicles. The automatic on-train monitoring during the normal runs of trains provides an alert for major hazards and short term maintenance. The other systems can be used for the long term to provide elaborated data regarding the track condition and track geometry.

The on-train computer can be programmed to perform various imaging-based detections for monitoring the WRI dynamics and certain selected track conditions. In monitoring the wheel rail interface, the system can be configured to detect flange climb, rapid vertical movement (e.g. wheel unloading), rapid lateral movement (hunting), and rail gauge distance to verify if the distance is within the safety tolerance. The system can be configured to detect defects and irregularities. Those 'effects', include, among others, the wheel climb or wheel unloading. Upon detection of an irregularities effect, a further investigation is triggered to find out the 'cause' of the irregularities, which may be, for example, a track defect, twisting of the rail, rolling stock problem, a problem with the lubrication between the wheel and the rail or any other irregularities with the track conditions or rail geometry. Notably, the system can detect the first sign (effect) in the case of multiple factors (causes), such as small track defects which may each be within the track standards and each alone may not be sufficient to cause derailment but the combination of these factors as a whole can lead to a derailment. In this regard, after the on-train monitoring system alerts a selected hazardous condition, the railroad operator initiates an investigation of the cause for the alerted hazardous condition by, e.g., dispatching an engineer or a track recording vehicle to inspect the location or locations of rail tracks where the alert is generated. Based on this detailed investigation, a proper corrective measure, if needed, is taken to rectify the defect and therefore mitigate the risk caused by the alerted hazardous condition.

FIG. 2 shows one example of the processing flow of the WRI monitoring and inspection process performed by the on-train computer. The output video is automatically analyzed by a WRI image processing software installed on the on-train computer. The system detects the irregularities and compares each detected irregularity to the predefined defects in the defect benchmark library. If the irregularity is equal to or exceeds a safety threshold, a defect type code is assigned to the image. The image of the irregularity is next transmitted to the track control work station in the off-train control center to be analyzed by a track expert. The transmitted data may include, e.g., the image of the irregularity, a section of the video recording (a few seconds before and after the irregularity), the location of the train from the GPS system, a corresponding defect code number from the library, the time of the detection, and the identification of the train and the route. As an option, data from the accelerometer on the train may be transmitted as well.

The images of irregularities from the different trains that are received at the control center may be limited to the images of irregularities which are detected by the system as exceeding the safety thresholds. The detailed analysis can be carried out on the workstation at the off-train control center. The track expert reviews the displayed still images and the associated section of a video recording and decides whether this is a defect to be further investigated or to be rectified by the track workforce on-site. If an action is needed, a new corrective action item can be logged on the system. The urgency of the problem can be defined in the log. If the defect is defined as an urgent matter, the maintainers can be contacted immediately. A track manager on-site may be authorized to close the log of the corrective action item.

The track expert at the control center can check the recordings from previous runs at the same location of the train where a defect is currently detected. A database with recordings from previous runs can be provided as a trend database. This is done in order to verify whether this is a repeated irregularity. In addition, the track expert can check whether there are any details about this irregularity in the trend database based on previous records. If the track expert decides that the irregularity is not a defect, the images can then be saved in the trend database for future comparison and analysis.

At the control center, the images can be viewed by the expert on the display screen together with the supporting data. The expert may edit the video recording and the images. Database software can be used for reporting the defects and for inserting diagnostic comments. A predetermined list of irregularities and comment descriptions may be used to minimize the time for inserting the data by the analyst. The control center may also include one or more high quality printers to print out the images. An inspection report can be issued on a regular basis, e.g., every day, to the track manager in each line and/or region. The report may include a list of the defects, their descriptions and the diagnosis of the track expert in addition to the image of the defect, location, time, train and line.

The on-train computer may be programmed to conduct a trend analysis of a given rail track. In implementations, this feature allows the system to perform a comparison between the current measurement and historical data from one or more prior monitoring runs. The historical data can be from a run that was undertaken a few weeks or days before the current run. As an example, if a significant change is detected for a certain irregularity from a previous run but it does not exceed the safety limit, the image may be stored in an anomalies trend database. Depending upon the nature of the irregularities, the rate of change, and the number of detections, a trend anomalies report to the track maintainers may be generated. This feature of the system may be configured to limit the number of irregularities which are not safety issues in the trend anomalies report, with the view of reducing the workload on the track maintainers. The associated trend anomalies database may include images that are not considered a safety risk but indicate a significant change from previous runs. In addition, the trend database may include images of irregularities that were previously identified by the system as safety defects but were determined not to be safety defects by the track expert. For such irregularities, no intervention is required by the track maintainers in the short term. The above trend analysis may be implemented at a computer off the train, e.g., at the control center.

When accelerometers are interfaced with the on-train monitoring system, information from the accelerometers installed on the wheel axis can be transmitted together with the image of the irregularity for correlation and verification purposes.

The track condition monitoring (TCM) mechanism in the on-train system is implemented in a separate TCM software module based on digital image processing techniques and algorithms including pattern recognition, image matching, or stereo vision technologies. In monitoring the track condition, the TCM software module can be configured to automatically detect certain selected missing critical track components via image processing. A digital defect library may be provided in the on-train computer to include images of defects that are used as benchmarks for the decision making as to whether a detected irregularity is a defect or not. The images of the library may be originally generated and recorded from a moving train in testing runs. This track condition monitoring provides to the railway operator signs of deteriorating track conditions. The system is configured to generate alert signals for only major hazards that could lead to derailment. The decision criteria can be formulated according to safety standard thresholds, e.g., if there are a number of missing ties in a row which exceeds a corresponding safety threshold, the system can highlight such a condition via an alert signal. The information provided by the track condition monitoring may be used in conjunction with the data received from the WRI detection to determine, in some cases, reasons for the irregularities.

In implementations, a track safety standard is used to set a threshold for a certain number of missing or defective critical components per a length of track or in a group of N ties. If the detected number of missing/defective components exceeds the safety threshold, a safety alert will be generated. As described above, an anomalies library will be generated as part of the inspection process for the comparison of the condition on site and the benchmark condition. The library can include images of critical components in an acceptable condition and in unacceptable condition.

The TCM inspection can be carried out during the normal run of the train. Once the system detects a missing/defective component, the detected component can be marked and stored in memory or database while the TCM inspection continues with components in the adjacent tie, and along the rail head. This process can proceed in sequence. If the number of missing or defective components detected by the system exceeds the safety standard thresholds, the data can be transmitted to the track control center. The transmitted data may include, e.g., still images of the detected components, a section of video recordings, definitions of the irregularities, location, time, train identification and route. The data received by the control center can then be analyzed by a track expert who decides whether this condition is a track defect and whether this condition requires a further investigation by the track maintainers on-site. The process of reporting the analysis by the track expert is similar to that in the WRI inspection. The results of TCM analyses may be validated with the WRI monitoring data. This could provide, in some cases, an explanation about the causes of the irregularities that are detected in the WRI inspection (effect).

The software module for the WRI monitoring and inspection is based on digital detection of moving objects in videos. Various motion detection techniques may be used. In one implementation, a Video Motion Detection (VMD), image matching, or stereo vision technologies may be in use. This software module is a powerful high performance software technology for outdoor environments, may be used to detect moving objects appearing in a video. The software is suitable to work in harsh outdoor conditions, when the camera moves, rotates or shakes, and when changes in the illumination conditions occur. The Software performances are not degraded by motion and vibration. It will work under poor illumination conditions and is compatible with night vision cameras. The software has high detection reliability with high resistance to false alarms and high sensitivity to very small moving objects. This is gained by using filters which can limit the detection to a specific direction, speed, amount of motion etc. In one implementation, for example, a set of virtual digital detectors may be used to detect different parts of an image and each detector tracks a small portion of the image. Each of the digital detectors is sensitive to motion, and when motion is detected, the detector turns on. In operation, video images of the interface between the wheel of the train and the rail track are captured when the train is in motion. The computer on the train digitally monitors a relative position and a relative motion of the wheel and the rail track. Digital motion detectors are to respectively monitor motion at different locations of a video image. The captured video images can be filtered to selectively detect motion in the video images.

The software module for the TCM may be based on digital pattern recognition in still images and videos and/or an Image Matching technology. Various pattern recognition techniques may be used. In one implementation, for example, an image matching or registration technique may be used to match two or more images which are misaligned relative to one another due to rotation, shifting and zooming of one image with respect to another. In addition, the matching can be performed when the two images are not exactly similar due to differences in weather conditions, using different types of cameras, or types of illuminations. The image matching algorithm may be integrated with the motion detection algorithm. With this integration, the motion detection may be achieved even when the camera moves, rotates or shakes, and when changes in the illumination conditions occur.

U.S. Pat. No. 6,798,897 entitled "Real time image registration, motion detection and background replacement using discrete local motion estimation" describes techniques for image registration and motion detection based on discrete representation of the location motion in an image to detect and track an object in video images. Such techniques may be implemented as part of the system's software.

The on-train monitoring system as illustrated in FIG. 1 may be designed to be as small and compact as possible and to allow for easy installation on and removal from the train. As an example, the equipment may be mounted on the train by using quick release devices. Each optical sensor may be mounted inside a rigid enclosure under the train with easy access. If possible, all the equipment onboard the train may be mounted in a single assembly on a rack/cabinet with easy access. The installation kit, which includes supporting brackets and electrical harnesses for the system, may be fitted as a provision on a number of trains and cars on each line/route. The provision for fitting can be designed for installing the system on different trains and on a few locations along the train and therefore can increase the reliability of the inspections by reducing the bias of the specific car or rolling stock.

Because the on-train system is installed on a regular train for carrying passengers or freight cars, the maintenance of the system should be designed to minimize the regular service. For example, a Line Replace Unit (LRU) approach may be used where in case there is a fault in one of the components of the system on the train, the whole assembly is replaced by a line technician and is sent for repair in a maintenance lab or an electronic workshop. If one of the sensors is faulty, the whole detectors-enclosure may be replaced with a spare unit. In this LRU approach, the downtime of the on-train monitoring system and any delays to the service of the train are minimized.

Therefore, the above examples and implementations illustrate that the on-train monitoring system can be designed to perform automatic inspections of the rail track monitoring Wheel Rail Interface (WRI) irregularities and selected critical track defects. Based on safety standards, the system operates to alert major hazards that may cause derailment. The automatic processing and detection by the computer during the normal service can also be used to identify immediate short term track maintenance needs. The on-train monitoring system can be used to support established routine track visual inspection activities by providing critical safety information more frequently and with enhanced quality. Notably, the frequent inspections (e.g., daily or whenever the train is operated) provided by the system can allow for timely identification of first signs of deterioration, enabling intervention before major risks develop. Using the system to inspect simultaneously on multiple trains and multiple lines can enable the railroad operators to cover the entire infrastructure on a daily basis.

The on-train monitoring system can be used in long trains. During the operation of long trains an unstable situation may occur which can cause a derailment. By installing cameras on different locations along the train length, the system may detect the first sign of an irregularity (e.g wheel climb on the rail) and therefore avoid such derailment.

To function effectively, the system can be designed to detect selected hazardous conditions based on safety standard thresholds for various defects to detect the effect on safety and leave the determination of the cause(s) to subsequent separate investigations. The system may be designed to compare changes of a measured parameter to a benchmark value or to compare changes to previous runs stored in the database.

Only a few implementations are disclosed. However, it is understood that variations and enhancements may be made.

What is claimed is what is described and illustrated, including:

1. A method for monitoring a rail track, comprising: providing an imaging module under a passenger or freight train to capture video images of the rail track under the train in motion; and automatically processing captured video images in a computer on the train to determine whether an irregularity is present on the rail track even before the irregularity degrades into a concern for a safe operation of the passenger or freight train.

2. The method as in claim 1, further comprising: capturing video images of an interface between a wheel of the train and the rail track when the train is in motion; and in the computer on the train, digitally monitoring a relative position and a relative motion of the wheel and the rail track; wherein the method further comprises conducting trend analysis.

3. The method as in claim 2, wherein the digital monitoring comprises: using a plurality of on-train digital motion detectors to respectively monitor motion at different locations of a video image.

4. The method as in claim 3, wherein the digital monitoring further comprises: digitally filtering a video image to selectively detect motion in the video image.

5. The method as in claim 2, further comprising: comparing to at least one of the relative position and the relative motion of the wheel and the rail track to a pre-determined safety standard threshold value; and sending a captured video image to a control center off the train for further analysis when the pre-determined safety standard threshold value is exceeded.

6. The method as in claim 1, where the digital processing of the captured video images in the computer comprises: digitally comparing the captured video images to stored images of irregularities of the rail track in a digital library to find a match; and sending a matched video image to a control center off the train to be further analyzed to determine the nature of the matched video image.

7. The method as in claim 1, further comprising: upon detection of an irregularity on the rail track that adversely affects safety of the train, generating an alert signal to notify the presence of the irregularity when the detected irregularity meets a pre-selected criteria.

8. The method as in claim 7, further comprising: conducting a further investigation of a cause for the irregularity in response to the alert signal.

9. The method as in claim 1, further comprising: upon detection of an irregularity on the rail track that adversely affects safety of the train, analyzing the image of the irregularity at a control center off the train to further determine the nature of the irregularity.

10. The method as in claim 1, comprising detecting a sign of the irregularity by monitoring multiple factors which are each within a track standard and each alone is not sufficient to cause a derailment but a combination of the factors can lead to a derailment.

11. The method as in claim 1, further comprising: providing one or more illuminating lights to illuminate the rail track to allow for capture of video images by the imaging module under a poorly lit condition.

12. The method as in claim 1, further comprising: providing at least one infrared sensor and/or MM Wave sensor in the imaging module to allow for capture of video images under a poorly lit condition and/or a poor visibility condition in bad weather.

13. The method as in claim 1, further comprising: engaging the imaging module removable on the train in a detachable manner; and replacing the imaging module when inoperable with a working imaging module to reduce an interruption to a service run of the train.

14. A method for monitoring a rail track, comprising: capturing video images from a moving passenger or freight train operating on the rail track during a regular service run of the train, by an imaging module located under the train; automatically processing captured video images in a computer on the train to determine whether an irregularity is present on the rail track according to a set of predetermined irregularity criteria; selecting video images that contain detected irregularities on the rail track for further analysis of each detected irregularity; and performing trend analysis.

15. The method as in claim 14, further comprising: transmitting the selected video images that contain detected irregularities on the rail track in real time off the train to a control center; and at the control center, analyzing each detected irregularity to determine the nature of the detected irregularity.

16. The method as in claim 14, further comprising: transmitting the selected video images that contain detected irregularities on the rail track off the train to a data storage device; transmitting the selected video images from the data storage device to a control center via a communication link; and at the control center, analyzing each detected irregularity to determine the nature of the detected irregularity.

17. A method for monitoring a rail track, comprising: capturing video images from a moving train operating on the rail track, by an imaging module located under the train; automatically processing captured video images using a digital motion detection algorithm to monitor an interface between a wheel of the train and the rail track; wherein the imaging module comprises (i) a first camera having a field of view (FOV) that is set to cover an interface between a right-hand rail and a corresponding right-hand wheel; (ii) a second camera having a FOV that is set to cover an interface between a left-hand rail and a corresponding left-hand wheel; (iii) a third camera that is set to cover a whole track including the two rails.

18. The method as in claim 17, wherein the digital processing comprises: using a plurality of on-train digital motion detectors to respectively monitor motion at different locations of a video image of the interface.

19. The method as in claim 18, wherein the digital processing further comprises: digitally filtering the video image of the interface to selectively detect motion of the interface.

20. A method for monitoring a rail track, comprising: capturing video images from a moving train operating on the rail track; automatically processing captured video images using a digital image matching algorithm to compare the captured video images to stored images of irregularities of the rail track in a digital library to find a match; analyzing a matched video image to determine the nature of an irregularity; generating an alert signal to alert an irregularity if a parameter of the irregularity exceeds a safety standard threshold; and updating an anomalies trend database if a significant change is detected for a certain irregularity from a previous run but does not exceed a safety limit.

21. The method according to claim 20, comprising detecting an irregularity by detecting at least one out of a rapid movement of a wheel of a train, a rapid lateral movement of the wheel of the train, a wheel of the train that climbs above a predetermined distance on a rail head, and a rail gauge that exceeds a predetermined threshold.

* * * * *